US006129485A

United States Patent [19]

Grabe et al.

[11] Patent Number: 6,129,485

[45] Date of Patent: Oct. 10, 2000

[54] SEAL AND PROCESS FOR PRODUCING SUCH SEAL

[75] Inventors: Werner Grabe; Siegfried Glang; Holger Gutschmitd, all of Hamburg, Germany; Simon Bernard, Eragny-sur-Oise, France; Bruno Haye, Coulommiers, France; Pierre Pallot, Gergy-le-haut, France

[73] Assignee: Phoenix Aktiengesellschaft, Hamburg, Germany

[21] Appl. No.: 08/913,669

[22] PCT Filed: Mar. 1, 1996

[86] PCT No.: PCT/FR96/00326

§ 371 Date: Feb. 20, 1998

§ 102(e) Date: Feb. 20, 1998

[87] PCT Pub. No.: WO96/27073

PCT Pub. Date: Sep. 6, 1996

[30] Foreign Application Priority Data

Mar. 1, 1995 [DE] Germany ..... 195 06 852
Mar. 28, 1995 [FR] France ..... 95 03637

[51] Int. Cl.[7] ..... E21D 11/38

[52] U.S. Cl. ..... 405/152; 405/147; 405/135; 277/626

[58] Field of Search ..... 405/135, 147, 405/152; 277/626, 625, 612, 615, 505, 590

[56] References Cited

U.S. PATENT DOCUMENTS

| | | | |
|---|---|---|---|
| 3,695,044 | 10/1972 | Hoshino et al. | 405/152 |
| 4,762,441 | 8/1988 | Glang | 405/152 |
| 4,797,032 | 1/1989 | Glang | 405/152 |
| 4,824,289 | 4/1989 | Glang et al. | 405/152 |
| 4,900,607 | 2/1990 | Glang et al. | 405/152 |
| 4,946,309 | 8/1990 | Glang | 405/152 |
| 5,044,823 | 9/1991 | Burgess | 405/152 |
| 5,074,711 | 12/1991 | Glang et al. | 405/152 |
| 5,888,023 | 3/1999 | Grabe et al. | 405/152 |

FOREIGN PATENT DOCUMENTS

| | | |
|---|---|---|
| 0147764 | 7/1985 | European Pat. Off. . |
| 0306581 | 3/1989 | European Pat. Off. . |
| 0443608 | 8/1991 | European Pat. Off. . |
| 2669259 | 5/1992 | France . |
| 2712655 | 5/1995 | France . |

*Primary Examiner*—Eileen D. Lillis
*Assistant Examiner*—Frederick L. Lagman
*Attorney, Agent, or Firm*—Blakely Sokoloff Taylor & Zafman

[57] ABSTRACT

The invention relates to a seal between a side face of a first part (11) and an application face (10), the seal being made of a compressible profiled lining (1) and being comprised of an internal portion (2) sealingly fixed to the first part (11) and an external portion (3) bearing on the application face (10). According to the invention, in its original condition prior to setting the seal on the first part (11), the external portion (3) of the liner (1) is provided with at least one profile tongue (4) housed inside at least one longitudinal groove (5) provided in said external portion (3) and opening on the side of the application face (10), said tongue (4) being fixed to the internal face (50) of said groove (5) in an easily detachable way so as to be able to suppress and eventually replace the tongue (4) at least on a portion of the length of the liner (1) in order to vary the compressibility degree of the liner on the corresponding length. The invention applies particularly to seals between the side faces of prefabricated concrete voussoirs for the construction of tunnels.

28 Claims, 3 Drawing Sheets

SEAL AND PROCESS FOR PRODUCING SUCH SEAL

The subject of the invention is a seal intended more specifically to be inserted between adjacent faces of two prefabricated concrete elements such as arch segments that form a tunnel lining, but it is applicable, in general, to forming a seal between two rigid components of any kind.

During the production of an underground tunnel, it is customary to produce a concrete lining that can be cast in situ but which may advantageously be made up of prefabricated arched elements known as arch segments made of reinforced or prestressed concrete and each covering a cylindrical sector. These elements have an arched, interior face and an arched exterior face, these faces being connected by lateral edge faces which in general are approximately flat and of which there are four, so that their development is approximately rectangular or in the shape of a trapezium. They are placed one after another in such a way that their lateral faces are contiguous and the tubular lining of the tunnel is thus produced as the excavation progresses.

It is necessary to form a seal between the prefabricated elements along their adjacent lateral faces, for example to prevent the ingress of water, and this is why gaskets made of a compressible material are generally inserted between the elements, these gaskets normally having to withstand a certain pressure difference between the interior face and the exterior face, for example a certain overpressure on the outside, that is to say exerted on the exterior face, particularly when the tunnel is below the level of the groundwater table.

To achieve this, each element may be fitted with a profiled gasket extending around the entire periphery of the element, along its lateral faces. When this is the case, the gaskets placed along the lateral faces, which are opposite each other, of two adjacent elements bear against one another.

To attach the gasket to the element, the element has a peripheral groove in which a corresponding part of the gasket is housed. This gasket may be held in simply by elasticity or alternatively may be bonded into the groove.

To reduce the length of gasket to be used, it can also be applied directly to a smooth lateral face of the adjacent element. When this is the case, each element may, for example, have a gasket attached to two of its lateral faces, the other lateral faces bearing directly on the gaskets of adjacent elements.

The profile and the transverse sectional dimensions of the gasket, as well as the properties of the material of which it is made, are determined to be such that the gasket, once the elements have been placed, is subject to a degree of compression capable of providing a seal against the pressure difference, between the interior face and the exterior face, to which the elements may be subjected and, for example, against the pressure of water coming in from outside.

However, the dimensions of the elements, the flatness of the lateral faces, and the relative positioning of the elements with respect to each other are unable, in practice, to be determined, with absolute certainty and this is why the compressive forces applied to the seals between the elements may vary.

Furthermore, to bore the tunnel, use is of ten made of a tunnel-boring machine which carries excavation means and also constitutes sheeting for protection against collapse and the ingress of water. This tunnel-boring machine is placed as an extension to the tunnel lining already produced and bears against the lining, by means of rams which allow it to be moved forward by the distance necessary to lay a further series of arch segments, when excavation has been carried out.

At least near to that end of the lining against which the tunnel-boring machine bears the prefabricated elements already placed are therefore subjected to the forces of the thrusting of the tunnel-boring machine, and the result of this is that the compressive forces applied to the joints between the elements as well as the clearance between two adjacent elements may vary in a way that is difficult to predict. This means that the amount of compression on the seal at some points may become too low for the required sealing to be guaranteed.

The purpose of the invention is therefore to propose a new type of seal making it possible to solve such problems and in particular allow a certain variation in the clearances between the elements.

Furthermore, the invention aims to propose such a seal which can exist in various alternative forms, by giving a very flexible solution to all the difficulties that may arise when constructing a tunnel, in terms of tolerances in the shaping of the faces between which a seal is to be provided, as well as in the relative positioning of these faces.

However, the invention is not restricted to this application and is applicable, in general, to the production of any seal inserted between a lateral face of a first component and an application face of a second component, this seal consisting of a profiled gasket made of an elastically compressible material extending in a longitudinal direction and comprising an internal part for attaching in leaktight manner to a lateral face of the first component and an external part for bearing on the application face.

In accordance with the invention, at least in its original condition before it is laid on the first component, the external part of the gasket is provided with at least one longitudinal profiled groove formed in said external part, delimited by an internal face and open on the opposite side to the internal part, and with at least one longitudinal profiled tongue housed inside the groove and attached to the internal face of the groove in an easily detachable way so that the tongue can be removed and possibly replaced at least over part of the length of the gasket in order to vary the degree of compressibility and/or the transverse dimensions of the seal along the corresponding length.

The seal according to the invention may be applied directly to an opposite face of the adjacent component, which then, by means of this opposite face, directly constitutes said application face, or alternatively to a seal, especially a similar seal, attached opposite on said opposite face, which seal then constitutes said application face.

To produce such a seal, the present invention proposes a method according to which molding or extrusion is used to produce the gasket which has said internal and external parts, this method being characterized in that while the gasket is being manufactured, there is produced, at the same time, in the external part, at least one longitudinal profiled groove delimited by an internal face and open on the opposite side to the internal part and a longitudinal profiled tongue housed inside the groove and attached to the internal face of the groove in an easily detachable way.

According to a particularly simple and advantageous embodiment of this method, while the gasket is being manufactured, the groove and the tongue are produced as a single piece with the gasket by forming, in the external part, at least one longitudinal empty space bounding the tongue and defining at least one easily tearable narrow band for connecting the tongue and the gasket together.

The seal according to the invention is therefore characterized in that the gasket with the groove and the tongue are produced as a single profiled piece, the tongue having, inside the groove, a transverse section smaller than that of the groove and being bounded by a lateral face which is connected to the lateral face opposite of the groove only by at least one narrow connecting band that can easily be torn in order to remove the tongue, said lateral faces being separated by an empty space, over the rest of the periphery of the tongue.

Once the seal has been manufactured, depending on the requirements and, for example, after the gasket has been attached, by its internal part, to the lateral face of the tongue, the tongue can be removed from the groove over at least part of the length of the seal, thereafter leaving the groove empty in order to improve its capacity for deformation and/or alter its transverse dimensions, to suit specific requirements, over the corresponding length, or replacing the removed tongue at least partially with an auxiliary profiled seal that is inserted and held in the groove in order to vary the degree of compressibility and/or the transverse dimensions of the seal, to suit specific requirements.

A person skilled in the art will readily understand how much a seal according to the invention can be customized, in terms of optimum geometry and optimum compressibility in order to obtain sealing, because it is possible, over the entire length of the seal or at chosen points along this length, either to keep the tongue in the groove, or to extract it and then replace or not replace it with an auxiliary seal which has chosen shape and compressibility properties. Thus the auxiliary seal may have a transverse section chosen from a range including a transverse section more or less equal to that of the groove and transverse sections which respectively have a height greater than the depth of the groove so as to stand proud from the gasket, or a height smaller than the depth of the groove so as to be set back inside the gasket, and it may have a rigidity chosen from rigidities that are respectively identical to, or greater or less than that of the gasket, which makes it truly possible to alter, to suit the requirements, along the length of a seal according to the invention, the shape, dimensions and compressibility properties of this seal, which properties were initially uniform along the entire length of this seal.

The nature of the auxiliary seal may itself vary to suit requirements and, in particular, it may or may not be a seal that swells in the presence of water.

The respective shaping of the groove and of the tongue may also be chosen freely within a broad range of possibilities.

Thus, when the tongue is made as a single piece with the gasket, as is preferred, provision may be made for the groove to have a polygonal transverse section and for the tongue inside the groove to have a polygonal transverse section that matches or alternatively differs from that of the groove and to be connected to the gasket by tearable narrow connecting bands especially placed at its corners. In particular, according to nonlimiting embodiments of the present invention, the groove and the tongue inside the groove have a transverse section in the shape of a trapezium or of a rectangle the long base, or a long side, of which points toward the internal part of the gasket, or alternatively, the groove has a transverse section in the shape of a rectangle a long side of which points toward the internal part of the gasket and the tongue has a transverse section in the shape of a T defined by a foot and a crossbar pointing respectively toward and away from the internal part of the gasket. Other shapes may, however, be chosen without in any way departing from the scope of the present invention.

Likewise, the tongue may have a configuration chosen from the configurations in which, respectively, it lies flush with the regions of the external part of the gasket directly adjacent to the groove, or stands proud of or is set back from these regions, depending on the conditions in which the gasket is intended to be used without removing its tongue.

A predetermined influence may also be had on the respective compressibility properties of the tongue and of those regions of the external part of the gasket that are situated respectively on either side of the groove, as well as of the internal part of the gasket, even when the tongue and the gasket are produced as a single piece, if at least one open or closed longitudinal channel is formed in the tongue and and/or respectively on either side thereof, in the external part of the gasket and/or if at least one open or closed longitudinal channel is formed in the internal part of the gasket while the latter is being manufactured. The presence of such a channel, of which there are at least one, then constitutes an additional feature of a seal according to the invention.

A person skilled in the art will readily understand that although the applications of a seal according to the invention may be highly varied, the adaptability of such a seal targets it quite specifically at civil engineering applications, that is to say in conditions in which it is sometimes difficult to meet tight tolerances in shapes, sizes, surface finishes and the relative positioning of components between which a seal is to be made.

The present invention therefore also relates to a concrete component, especially an arch segment, having a lateral face to which a seal is attached facing an application face belonging to another, adjacent, component, characterized in that the seal is a seal according to the invention, obviously in any one of its versions of initial shape and adaptation over all or part of its length.

When the component in question has two copies of said lateral face, defining a corner between them, provision may be made for each of these copies to be fitted with a seal according to the invention as far as this corner, where the seals are then laid contiguously, for example mitered, although this may pose installation problems and give rise to defective sealing.

When such is the case, an embodiment which is preferred is therefore one characterized in that each of the copies of said lateral face is fitted with a seal in accordance with the invention except for a respective region directly adjacent to the corner, and in that the corner and the directly adjacent regions are fitted with a shaped seal connected in leaktight fashion to the seals of the lateral faces. This connection may be accompanied by the respective gaskets being secured together, for example by vulcanizing or alternatively by any other means of leaktight connection before the seals are laid on the component.

The shaped seal may be chosen from a broad range of possibilities, but in a preferred embodiment it comprises a shaped gasket connected in leaktight fashion to the gaskets of the seals of the lateral faces and comprising an internal part for attaching to said regions adjacent to the corner and an external part for bearing on a respective application face and this external part delimits a sealed cavity housing a mass of material that swells in the presence of water. In one embodiment, the cavity is closed on the opposite side to the internal part by an impervious elastic membrane but opens toward the groove of the gaskets of the seals of the lateral faces so that by detaching at least one of the tongues from these gaskets, especially in a localized way in immediate proximity to the shaped seal, the leaktight barrier around the mass of material that swells in the presence of water can be broken and this material therefore allowed to swell under the effect of the ambient moisture, the elastic membrane taking on a bulged shape until it presses firmly, in conditions capable of guaranteeing a seal, against an application face belonging to an adjacent component. In another embodiment, for this same purpose, the cavity is closed on the opposite side to the internal part by an impervious membrane that can be torn, perforated or cut so that by tearing, perforating or cutting said membrane the leaktight barrier around the mass of material that swells in the presence of water can be broken.

It is thus possible to achieve an effective seal at the corner of the component, that is to say at a point which is usually particularly tricky to seal.

Naturally, in an assembly of a concrete component in accordance with the present invention and of at least one other, adjacent, concrete component, especially another arch segment that has a face opposite said lateral face, provision may be made, just like in the prior art, for the seal according to the invention to be applied directly to said opposite face, that then constitutes the application face, or to be applied to a seal, especially one according to the invention, attached to this opposite face and constituting the application face.

The invention will be better understood if reference is made to the following description of a number of nonlimiting embodiments, as well as to the appended drawings which form an integral part of this description. In these drawings.

Figure 1:
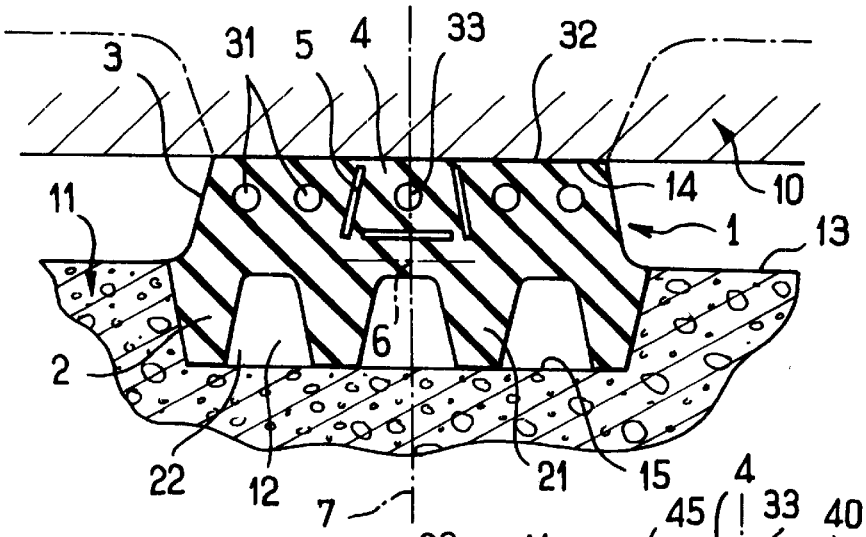
FIG. 1 is a view in transverse section of a seal with a groove and tongue according to the invention.

Depicted in FIG. 1 is a seal according to the invention consisting of a profiled gasket 1 made of an elastically deformable material, especially an elastically compressible material, extending in a longitudinal direction 6 and attached, for example, by bonding, to a support component 11 in order to provide a seal between a lateral face 13, which is generally flat, thereof and an application face 14, which is also generally flat, of an adjacent component 10. The application face 14 opposite and more or less parallel to the lateral face 13 may be defined either directly by the component 10, as has been illustrated in solid line, or by another seal, for example one according to the invention, attached in leaktight fashion to a lateral face of this component 10, as has been illustrated in chain line.

By way of nonlimiting example, the components 10 and 11 may in particular consist of concrete arch segments whose face 13 and, respectively, application face 14 or lateral face carrying a seal defining the application face 14 constitute a respective edge face.

In the conventional way, the gasket 1 comprises a longitudinal internal part 2 which is housed in a longitudinal groove 12 of the lateral face 13 of the component 11 and a longitudinal external part 3 which extends standing proud from the groove 2 to be pressed, via an external face 32 parallel to the face 13, against the application face 14 of the adjacent component 10.

The assembly formed by the gasket 1 and the groove 12 preferably has symmetry with respect to the longitudinal plane 7 and, in particular, the groove 12 and therefore the internal part 2 of the gasket 1 for example has a transverse section in the shape of an isosceles trapezium the short base of which defines a bottom 15 of the groove 12, which bottom is flat and parallel to the face 13, although other configurations may be chosen without in any way departing from the scope of the present invention. Likewise, the external part 3 of the gasket 1 for example has a section in the shape of an isosceles trapezium the short base of which corresponds to the external face 32 and the long base of which corresponds to the region where it meets the internal part 2, that is to say to the long base of the isosceles trapezium defined by the transverse section of this internal part in the example above, but other configurations may also be chosen for this aspect.

Figure 9:
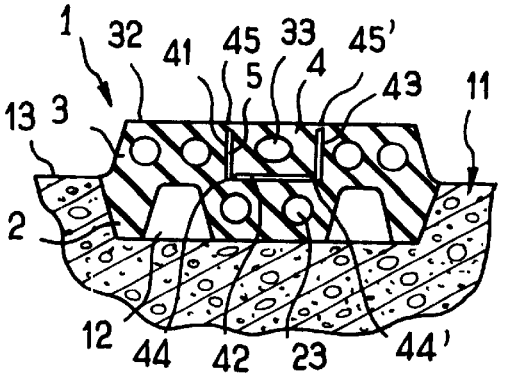

The internal part 2 of the gasket 1 advantageously consists of several longitudinal ribs 21 delimiting between them longitudinal channels or empty spaces 22 open toward the bottom 15 of the groove 12, for example with a transverse section in the shape of an isosceles trapezium the long base of which corresponds to this bottom 15, giving a possibility for elastic deformation for inserting the gasket 1 into the groove 12 and holding it there in a sealed manner. As an alternative, these open channels could be absent, or replaced in full or in part by closed longitudinal channels or empty spaces, for example with a circular transverse section, as has been illustrated at 23 for the versions of gasket 1 that have been illustrated in FIGS. 9 and 10.

The channels 22 or 23 also increase the capacity for deformation of the seal under the effect of a compressive force. For this same purpose, the external application part 3 of the gasket 1 may be fitted with empty spaces or longitudinal channels 31, which are preferably closed and, for example, have a circular transverse section.

The gasket 1 may be produced in the conventional way by molding or extruding a compressible elastic material such as a natural or synthetic rubber or a polymer, with any channels 22, 23, 31 being formed directly during this manufacturing.

In its external part 3, at the central part of its external face 32, the gasket 1 is furthermore equipped with a longitudinal tongue 4 produced at the same time as the gasket 1, during the molding or extrusion thereof, and preferably as a single piece with the gasket 1 and of the same material as the latter. For this, the molding or extrusion is carried out in a way that makes it possible to separate by an empty longitudinal space in the constant transverse section profiled longitudinal component thus molded and extruded, a lateral face 40 of the tongue 4 from a face 50 opposite it of the gasket 1 which thus delimits a groove 5 opening into the external face 32. The longitudinal channels 31 may be arranged respectively on either side of the groove 15 just as the tongue 14 may be equipped, while it is being molded or extruded, with at least one other longitudinal channel 33, preferably a closed one, for example with a circular transverse section as has been illustrated in FIGS. 1 to 3, or some other transverse section especially an oval one as has been illustrated in FIG. 9 for an alternative form of tongue and gasket; furthermore, closed longitudinal channels may be produced in a similar way in the region where the internal and external parts 2, 3 of the gasket 1 meet, these for example, having a circular transverse section as has been illustrated at 24 in FIG. 8 for the case of another alternative form of gasket.

Figure 2:
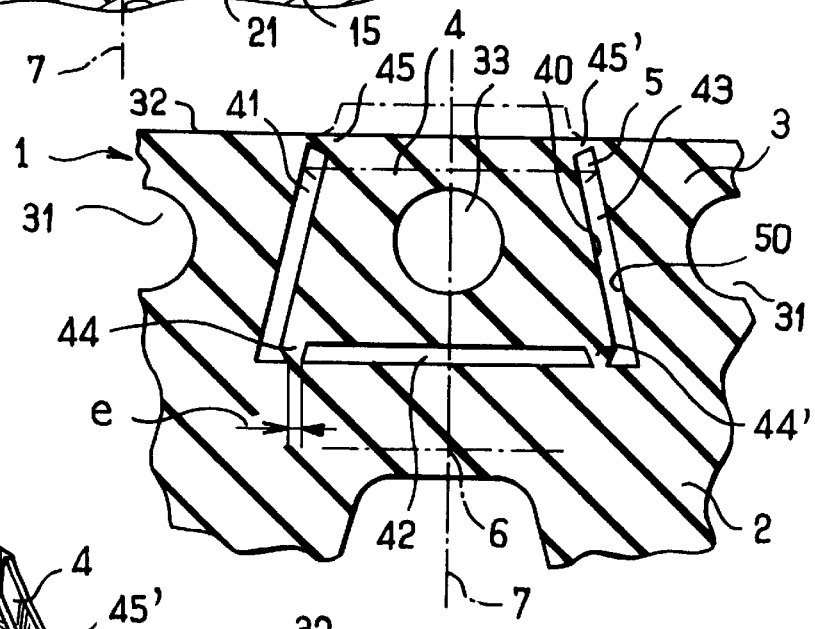
FIG. 2 is a detail of FIG. 1, on an enlarged scale.

For example, as can be seen in greater detail in FIG. 2, the longitudinal tongue 4 is bounded by flat longitudinal empty spaces 41, 42, 43 which, in this embodiment, give the tongue 4 like the groove 5 a transverse section in the shape of a trapezium whose long base, which consists of the empty space 42, points toward the inside of the gasket 1, that is to say toward the internal part 2 thereof; the short base for its part coincides with a coplanar extension of the face 32 opposite of the groove 5, in this example in which the tongue 4 lies flush with the regions of this face 32 that neighbor it, respectively on either side of the groove 5. The empty spaces 41, 42, 43 are made in the mass of the gasket 1 while the latter is being molded or extruded and their ends are separated from one another by a small distance (e). Thus the central empty space 42 is separated from the base of the lateral empty spaces 41, 43, that is to say from their region furthest from the face 32, by two longitudinal narrow bands of material 44, 44' which have a small thickness corresponding to the distance (e) left free between the empty spaces. Likewise, the lateral empty spaces 41 and 43 end a small distance from the external face 32 of the gasket so as to leave two thin narrow longitudinal bands 45, 45' at the top corners of the tongue 4, that is to say at its region adjacent to this face 32.

This means that the longitudinal tongue 4 has a transverse section smaller than that of the groove 5 and is connected to the rest of the gasket 1 only by four slender narrow bands of material 44, 44', 45, 45' which connect its lateral face 40 to the face 50 of the groove 5 at the four corners of the trapezoidal section but which can be easily torn. As has been depicted in the figure, to make tearing easier and to avoid the risk of damaging the gasket, the narrow connecting bands may be made even thinner on the gasket side and wider toward their base, that is to say on the same side as the tongue 4.

Figure 3:
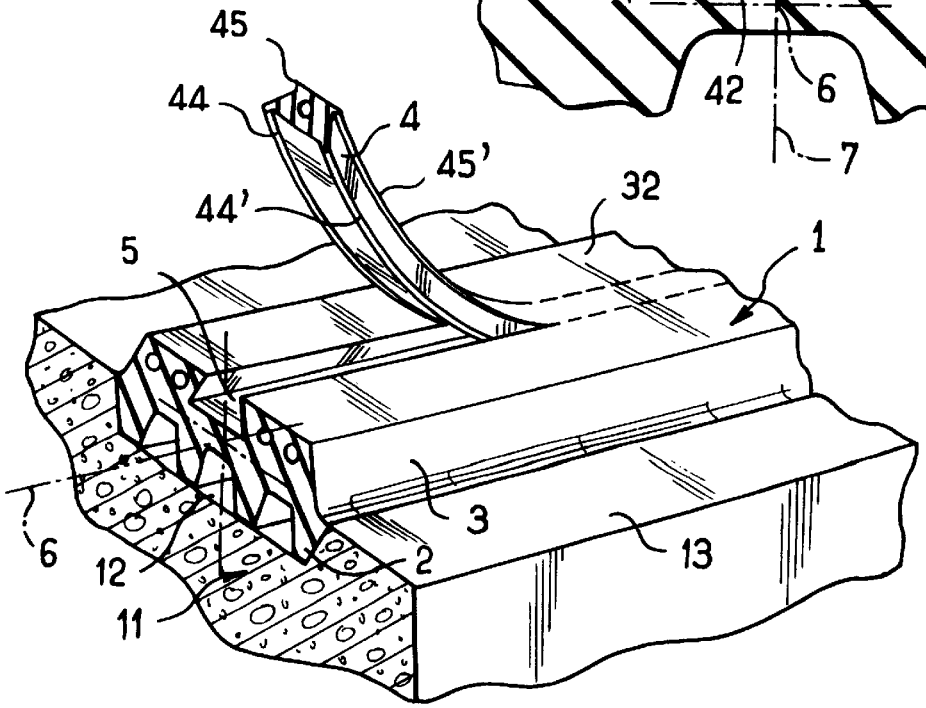
FIG. 3 is a part view in perspective of the seal of FIG. 1.

In that way, as has been indicated diagrammatically and in perspective in FIG. 3, after the gasket 1 has been laid on the concrete support component 11, it is possible to lift the tongue 4 partly, detaching it from the gasket 1 by tearing the narrow connecting bands 44, 44', 45, 45'. As it is raised, the tongue 4 thus frees, at the center of the gasket 1, the groove 5 with trapezoidal section defined by the external faces of the empty spaces 41, 42, 43.

Depending on the requirements, the tongue 4 may thus be removed, generally but not exclusively after the gasket 1 has been attached to the support component 11 and to suit specific requirements observed on laying the components 10 and 11, either over the entire length of the seal or just over part of the seal, the removed part being detached from the remaining part by cutting.

Figure 4:
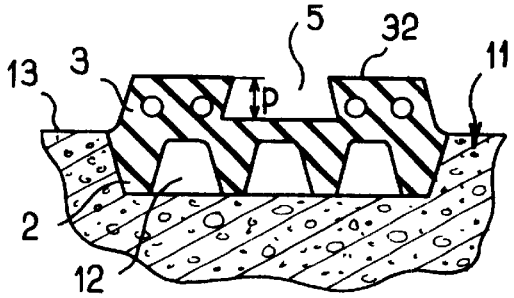
FIGS. 4 to 7 show, in transverse section, various ways in which the seal of FIG. 1 can be used.
Figure 6:
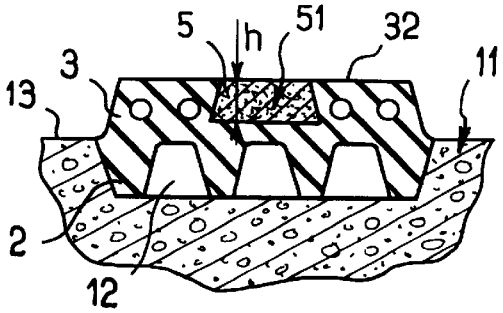
Figure 5:
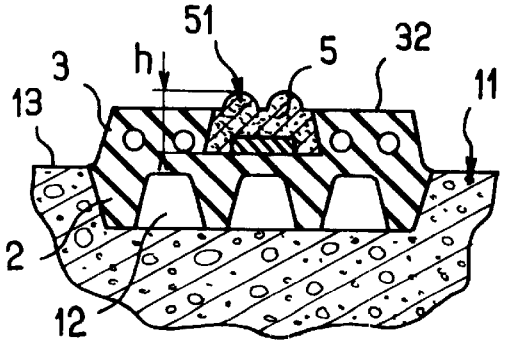

An embodiment of this sort can actually be used in a number of ways which are depicted diagrammatically in FIGS. 4, 5, 6.

First of all, the seal may be used normally in the condition depicted in FIG. 1, that is to say without removing the central tongue 4.

The properties of the gasket 1 comprising the central tongue 4, especially its dimensions and its degree of compressibility, are thus determined to suit the normal conditions of use that correspond to the components 10 and 11 being positioned perfectly one with respect to the other with the clearance necessary for fitting the seal and obtaining the desired contact pressure for achieving the sought after seal.

In the regions where there is a risk that the clearance between the adjacent components 10, 11 might be too small, it is possible simply to remove the tongue 4 without replacing it, as has been depicted in FIG. 4. By thus reducing the working section of the seal over all or part of its length, to suit the specific requirements, the central groove 5 being empty, its compressibility is increased and the seal can therefore deform further to guarantee adequate sealing.

By contrast, in regions where there is a risk that the clearance may be too high, once the tongue 4 has been removed over at least the corresponding length, it can be replaced in the groove 5 by an auxiliary profiled seal 51 which has a transverse section such that its thickness or height (h) is greater than the depth (p) of the groove 5, perpendicular to the bottom 21 thereof and to the external face 32 of the gasket, so that it stands proud from the gasket as has been depicted in FIG. 5. Such an embodiment makes it possible to adapt the thickness of the seal thus formed of the gasket 1 and of the auxiliary seal 51 to suit the clearance, perpendicular to the bottom 15 of the groove 5, for example when the components 10, 11 laid are significantly unlevel, so as to obtain the degree of compression needed to guarantee the contact pressure required for sealing. In the example illustrated in FIG. 5, this additional thickness of the auxiliary seal 51 takes the form of two juxtaposed longitudinal rolls made as a single piece of a material that swells in the presence of water with a longitudinal base that exactly fills the groove 5 and embedding a strip of material that does not swell in the presence of water stuck in the bottom 15 of the groove 5 so as to encourage the auxiliary seal to swell in the heightwise direction should water leak in between the gasket 1 and the application face 14, using a technique which is well known in itself, but it is clearly understood that other forms could be chosen without in any way departing from the scope of the present invention.

Figure 7:
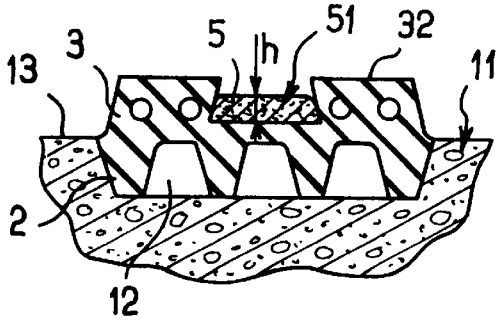

What is more it is possible to have a number of profiles of auxiliary seal in order to meet various requirements and, in particular, the auxiliary seal 51 may also have a transverse section such that its height (h) is less than the depth (p) of the groove 5 perpendicular to the bottom 12 of the groove 5 and to the external face 32 of the gasket 1, so that it can be set back inside the gasket relative to this external face 32 when it is held in the bottom of the groove 5, as shown in FIG. 7. This arrangement is advantageously accompanied by the choice of an auxiliary seal 51 of the type which swells in the presence of water, the thickness of which increases in the event of leaking water and thus automatically matches itself to the shape and relative position of the components 10 and 11 to produce a seal between them.

Furthermore, it is also possible to increase the contact pressure without altering the thickness of the gasket, by varying the rigidity of the auxiliary seal. For example, in the embodiment depicted in FIG. 6, the auxiliary seal 51 has a transverse section which is more or less identical to that of the groove 5 so that it fills it completely, its height (h) being uniformly equal to the depth (p) of the groove 5. The lateral empty spaces 41, 42, 43 are thus dispensed with in order to obtain the comparatively small desired degree of compressibility in the normal conditions of use; likewise, the auxiliary seal 51 may be produced without any empty spaces so as to increase the working section of the gasket and thus its rigidity. The auxiliary seal 51 may therefore be produced of the same material as the gasket 5 which will give this effect, but the seal 51 could also be produced in a material which is more rigid than that used for the gasket 1.

The seal thus produced therefore better withstands compression and as its deformation is less, it allows the sealing effect to be improved by increasing the contact pressure, for example in regions where excessive clearance between the elements might be feared.

A person skilled in the art will readily understand that in this way it is possible, starting with a seal according to the invention like the one illustrated in FIG. 1, that is to say a seal which comprises both the gasket 1 and the detachable tongue 4, to alter the shape and dimensions of the transverse section of the seal as well as its rigidity to suit the specific requirements by using it as it is, that is to say with the tongue 4, or without the tongue 4 or the auxiliary seal 51, or without the tongue 4 but with an auxiliary seal 51, especially selectively along different parts of the length of the seal, to suit the respective requirements. Likewise, when an auxiliary seal 51 is used, its transverse section may be chosen to be such that it corresponds to that of the groove 5, or that its height (h) is greater or less than the depth (p) of this groove, associating this choice with a choice of compressibility which is identical to, or greater or less than that of the gasket 1, by choosing the material and/or shape of this auxiliary seal 51, possibly selectively, to suit the respective requirements in different parts of the length of the seal. The nature of the auxiliary seal 51, especially whether or not it swells in the presence of water, may also be chosen at will, to suit that of the gasket 1, also chosen at will, in order to obtain any desired effect by cooperation between auxiliary seal 51 and gasket 1.

The invention thus provides a seal that can easily be adapted to suit the various situations encountered in practice; in regions where a problem with sealing is identified, it is possible to remove the tongue simply by "peeling it" and possibly replace it in full or in part with an appropriately chosen auxiliary seal so as to vary the compressibility and even the thickness of the seal at the desired point.

Figure 8:
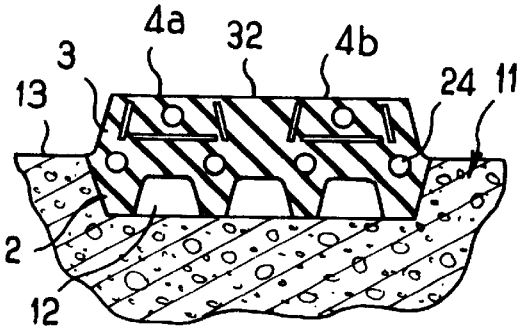
FIGS. 8 to 10 show, in transverse section, other embodiments of a seal according to the invention.

Furthermore, the description has concentrated on the case of a single tongue 4 placed in the central part of the seal, but it would be possible, for example, in the case of a very wide seal, in the same way to produce several parallel tongues 4*a*, 4*b* as has been depicted in FIG. 8, the possibilities for using this being the same as those illustrated in FIGS. 4 to 7.

It will be noted that the trapezoidal shape of the groove 5 depicted in FIGS. 1 to 7 and 8 allows the auxiliary seal to be fitted instantly simply by clipping it into the groove.

Of course, the invention is not however limited to the details of the embodiments which have just been described simply by way of example. In particular, the internal part 2 of the gasket 1 and the groove 12 in the prefabricated element 11 into which groove the gasket is placed could have shapes other than the trapezoidal shape described, as can the external part 3 of the gasket 1.

The detachable tongue 4 and the groove 5 could themselves have a shape other than the trapezoidal shapes described, while still matching each other. For example, as has been illustrated in FIG. 9, they could have a rectangular transverse section, that of the tongue 4 being smaller than that of the groove 5 owing to the presence of the flat empty spaces 41, 42, 43, the tongue 4 lying flush with the external face 32 of the gasket along a long side of the rectangle while the other long side thereof points toward the internal part 2 of the gasket 1; the tearable narrow bands 44, 44', 45, 45' would still, however, be arranged at the four corners of the, here rectangular, section of the tongue 4 and of the groove 5.

Furthermore, the tongue 4 and the groove 5 could have respectively different polygonal transverse sections, if empty spaces of a larger section were formed for releasing the tongue 4. For example, as has been illustrated in FIG. 10, the groove 5 could still have the rectangular transverse section described with reference to FIG. 9, and the tongue 4 could have a transverse section in the shape of a T defined by a foot 46 pointing toward the internal part 2 of the gasket and connected thereto by a single central tearable narrow band 48, and by a crossbar 47 pointing away from the internal part 2 and lying flush with the external face 32 of the gasket 1 and connected thereto, in immediate proximity to this face 32, by two tearable narrow bands 49, 49' placed at two opposite corners of the crossbar 47.

Furthermore, in general, the profile and the dimensions of the peelable tongue according to the invention, which is made by molding or by extrusion at the same time as the gasket, may be customized and, in particular, instead of lying flush with the external face 32 of the gasket 1 and as has been illustrated in chain line in FIG. 2 the tongue 4 could be set back from those regions of this external face that are adjacent to the groove 5, or by contrast stand proud of these regions, with the shape of transverse section chosen at will at this projecting part, in which case the description just given would apply not to the tongue considered in its entirety but to that part of this tongue that lies inside the groove.

Furthermore, although it is possible to resort to a seal with a detachable tongue in accordance with any one of the embodiments which have just been described or alternative forms which have not been described but which do not depart from the scope of the present invention for providing the entire seal between a component and one or more adjacent components, the latter case being, for example, that of a corner of an arch segment defined by two lateral faces adjacent to another respective arch segment on account of the alternating laying of arch segments, well known to those skilled in the art, sealing may also be achieved by combining seals of this type with detachable tongues with other types of seal, joined end to end.

Thus, in the case of an arch segment, a sealing frame may be produced around the entire periphery of the arch segment, this periphery being defined by lateral faces thereof, the faces in twos forming corners, by using seals with detachable tongues along the entire length of the lateral faces with the exception of a small part of this length directly adjacent to the corners, and by using shaped seals that match the shape of the corners in regions directly adjacent to these corners, with the various types of seal being joined together end to end in leaktight fashion.

Thus FIGS. 11 to 14 illustrate the formation of a seal around a corner 16 formed by two lateral faces 13 of the support component 11, for example a prefabricated concrete arch segment.

At the corner 16, the two lateral faces 13 meet, at right angles as is illustrated or defining an angle other than a right angle, along a straight solid angle of intersection 17 that is transverse with respect to a respective longitudinal direction 6 and each of these faces has, along its entire length, as far as the solid angle of intersection 17, the longitudinal groove 12 for accommodating a gasket 1 with detachable tongue 4.

However, the groove 12 in each lateral face 13 accommodates a gasket 1 of this type only over most of its length, namely over all of its length except for a respective region 18 directly adjacent to the corner 16 and for example extending over a distance of the order of about 10 to 30 centimeters when the support component 11 is an arch segment, these values being indicated by way of nonlimiting example.

Figure 10:
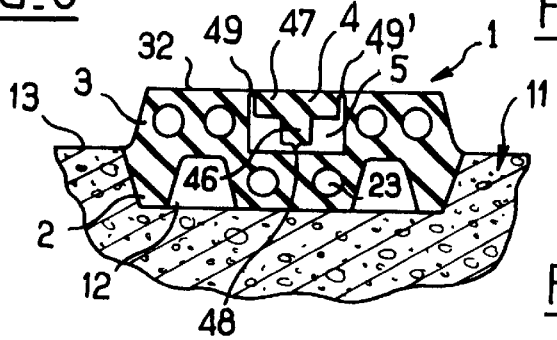
Figure 11:
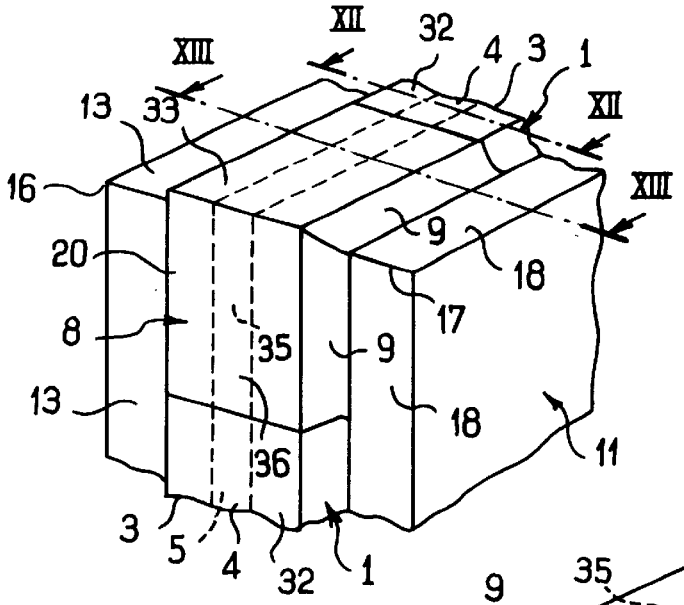
FIG. 11 shows a perspective view of a corner of a component fitted with a shaped seal connecting two groove and tongue seals according to yet another embodiment.
Figure 12:
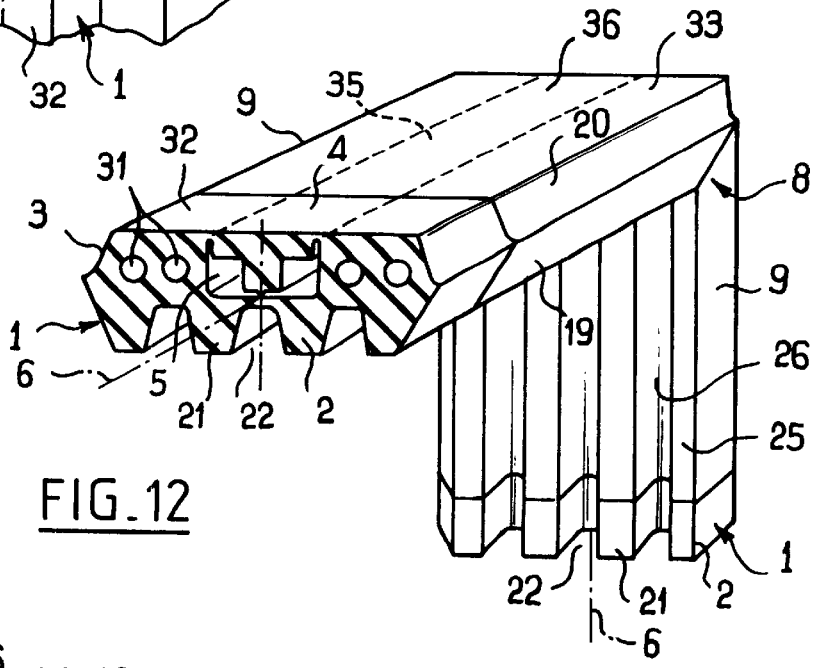
FIG. 12 shows a view of these seals in perspective and in section on a plane transverse to one of the groove and tongue seals, and referenced XII—XII in FIG. 11.
Figure 13:
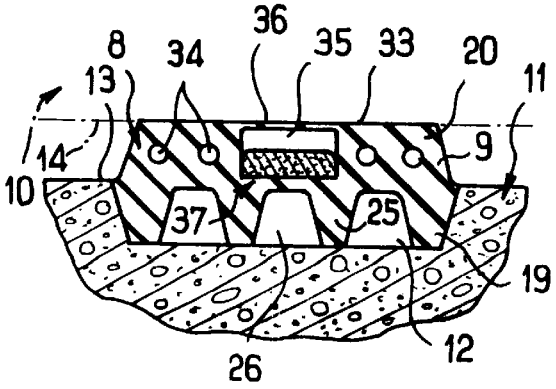
FIG. 13 shows a view of the shaped seal, in section on a plane parallel to the plane XII—XII and referenced XIII—XIII in FIG. 11.
Figure 14:
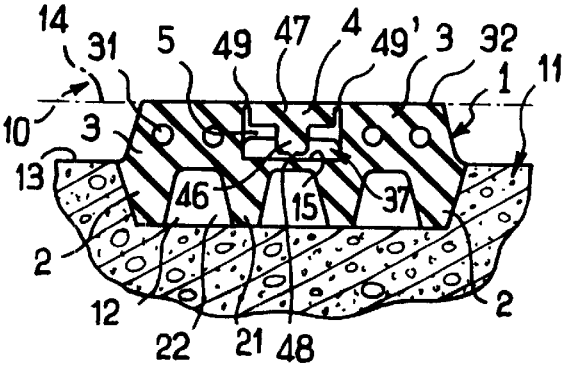
FIG. 14 shows another view of the groove and tongue seal illustrated in section in FIG. 12, in section on the same transverse plane XII—XII.

Obviously the gasket 1 used in this case may be any one of the types previously described or alternatively be an alternative version thereof, as shown in FIGS. 12 and 14 where it can be seen that in this nonlimiting example the gasket 1 has an internal part 2 as described with reference to FIG. 1, that is to say a part formed of an alternation of longitudinal ribs 21 and longitudinal ribs 12, while its external part 3 is produced in accordance with FIG. 10, that is to say comprises a detachable tongue 4 which has a T-shaped transverse section, housed inside a groove 5 of rectangular transverse section, the detachable tongue 4 having a foot 46 connected to the bottom 15 of the groove 5 by an easily tearable narrow band 48 and a crossbar 47 lying flush with the external face 32 of the gasket 1 and connected to the rest thereof, in immediate proximity to this face 32, by two narrow bands 49, 49' which are also easily tearable; it is, however, clearly understood that any other design of gasket and of detachable tongue could be chosen without in any way departing from the scope of the invention.

At the limit of each region 18, each gasket 1 is cut along a transverse plane via which it connects in leaktight fashion, preferably being secured together for example by vulcanizing when the materials in question lend themselves to such an operation, to a shaped seal 8 extending each of them as far as the solid angle of intersection 17 and matching the shape of the corner 16. For this, the seal 8 has the overall shape of an angle bracket with two straight legs 9, advantageously produced as a single piece, meeting at right angles in the example illustrated or at any angle to suit the corner 16, and each of which longitudinally extends a respective one of the gaskets 1 over the respectively corresponding region 18 as far as the corner 16.

Advantageously, the gasket 8 is produced as a single piece from a material identical or similar to that of the gaskets 1, and each of its legs 9 externally has a transverse section identical to that exhibited externally by the gaskets 1 so that they can be connected to the latter in the best possible way.

Thus, in the example illustrated, the seal 8 in each of these legs 9 has an internal part 19 which at every point is identical to the internal part 2 of the gaskets 1 used, that is to say which like the latter has an alternation of ribs 25, each of which longitudinally extends a rib 21 and which connect up from one leg 9 to the other, and of grooves 26, each of which longitudinally extends a respective groove 12 and which also connect up from one leg 9 to the other. The internal part 19 is thus fitted and held in the groove 12 in the same way as the internal part 2 of the gaskets 1. If appropriate, the internal part 19 of each leg 9 may be attached, for example by bonding, to the inside of the corresponding groove 12.

In each of these legs 9 the gasket 8 also has an external part 20 which has a number of similarities with the external part 3 of a gasket 1.

Intended to be pressed in leaktight fashion against the same application face 14 of the gasket 1 which it extends, the external part 20 of the gasket 8 at each of its legs 9 in the coplanar extension of the external face 32 of the respectively corresponding gasket 1, has an external face 33 which has a flat shape when the gasket 8 is not stressed.

Furthermore, the external part 20 internally has channels 34 which are identical to and arranged in exactly the same way as the channels 31 of the external part 3 of the corresponding gasket 1, so that each of these channels 34 longitudinally extends a respective channel 31 and so that the channels 34 connect up from one leg 9 to the other at the corner 16.

Furthermore, the external part 20 of the gasket 8 at each of the legs 9 has an internal cavity 35 which has a transverse section more or less identical to that of the groove 5 of each of the gaskets 1 so as longitudinally to extend this groove 5 as far as the corner 16 where the cavities 35 associated with the two legs 9 meet.

In contrast to the grooves 5, the cavity 35 is not closed, toward the external face 33, by a detachable tongue but by an elastically extensile impervious membrane 36, advantageously made as a single piece with the rest of the gasket 8 to which it is connected in leaktight fashion respectively on either side of the cavity 35 in immediate proximity to the external face 33 so as to delimit the cavity 35 in a way that is sealed from the rest of the gasket 8. However, the cavity 35 is still open toward the grooves 5 of the gaskets 1, the tongues 4 of which hold and seal the cavity 35 for as long as they are present, but tearing these tongues away, even partially, is enough to break the leaktight barrier to the cavity 35.

Housed inside the cavity 35 is a mass 37 of material that swells in the presence of water, for example a mass of material marketed under the registered name of "HYDROTITE", this mass 37 having a volume that is less than or at most equal to that of the cavity 35 when it is isolated from moisture but capable of having a volume that exceeds that of the cavity 35 causing the gasket 8 to swell with elastic deformation of the membrane 36 when this mass 37 of material that swells in the presence of water becomes moist.

Thus, if the geometry and the conditions of laying of the components 10 and 11 where the gasket 8 is to provide a seal allow this seal to be achieved with the original configuration of gasket 8, that is to say a configuration in which the mass 37 occupies its minimum volume and the elastic membrane 36 has a flat configuration extending the face 33 of the external part 20 of the gasket 8 in the same plane, the components 10 and 11 are laid keeping moisture away from the seal 37 that swells in the presence of water, that is to say leaving the tongues 4 in place in the gaskets 1 or, if there is a need to remove these tongues 4, replacing them at least locally with an auxiliary seal which keeps the cavity 35 sealed; if, on the other hand, the gasket 8 in its original condition is unable to provide the required sealing, and more particularly if the clearance between the faces 13 and 14 is too great, the leaktight barrier of the cavity 35 can be deliberately broken by tearing at least one of the narrow bands 49, 40', by removing the tongue 4 from one of the adjacent gaskets 1 or from both gaskets, even if only locally, or by leaving these tongues 4 in place or alternatively replacing them at least locally with an auxiliary seal giving free access to the cavity 35 so that moisture can reach the mass 37 of material that swells in the presence of water and cause it to swell until, on account of this swelling, the membrane 36 projects from the face 33 and presses against the application face 14 of the component 10 thus ensuring a continuous seal at the corner 16 and the regions 18 adjacent thereto. It is clearly understood that just like a gasket 1, a gasket 8 can cooperate directly with a face of the component 10 or with a gasket 1 or 8 or alternatively a gasket of some other type with which such a face is equipped, to provide the intended seal.

As an alternative, the membrane 36 may be designed so that it can easily be torn, perforated or cut, in which case the cavity 35 may be integrally closed in leaktight fashion, that is to say may not communicate with the grooves 5 of the adjacent gaskets 1; in this case it is by tearing, perforating or cutting the membrane 36 that the leaktight barrier of the cavity 35 can be broken and moisture left to reach the mass 37 of material that swells in the presence of water in order to bring about the aforementioned swelling thereof until there is leaktight contact with the application face 14; it is then no longer necessary to detach the tongue 4 from one of the adjacent gaskets 1 in order to achieve this effect.

Obviously the embodiments of a shaped gasket 8 which has just been described are merely two nonlimiting examples, it being understood that every effort will be made to best suit the respective configurations of shaped gasket 8 and of gasket 1 with detachable tongue to which it is to be attached. Advantageously, when the issue is that of producing a seal over the entire polygonal periphery of a component, as may be the case when the issue is that of producing such a seal on all the lateral end faces of an arch segment, a sealing frame may be prefabricated, this frame being formed of an assembly of the necessary gaskets 1 connected in pairs by shaped gaskets 8, before laying this frame on the component, or incorporating this frame into this component at the time of its manufacture, if its method of manufacture lends itself to such an operation.

What is claimed is:

1. Seal between a lateral face of a first component and an application face of a second component, the seal consisting of a profiled gasket made of an elastically compressible material, extending in a longitudinal direction and comprising an internal part for attaching in leaktight manner to the lateral face of the first component and an external part for bearing on the application face, characterized in that, at least in its original condition before it is laid on the first component, the external part of the gasket is provided with at least one longitudinal profiled groove formed in said external part, delimited by an internal face and open on the opposite side to the internal part, and with at least one longitudinal profiled tongue housed inside the groove and attached to the internal face of the groove in an easily detachable way so that the tongue can be removed and possibly replaced at least over part of the length of the gasket in order to vary at least one of the degree of compressibility and the transverse dimensions of the seal along the corresponding length.

2. Seal according to claim 1, characterized in that the gasket with the groove and the tongue comprising a single profiled piece, the tongue having, inside the groove, a transverse section smaller than that of the groove and being bounded by a lateral face which is connected to the lateral face opposite of the groove only by at least one narrow connecting band that can easily be torn in order to remove the tongue, said lateral faces being separated by an empty space, over the rest of the periphery of the tongue.

3. Seal according to claim 2, characterized in that the groove has a polygonal transverse section and the tongue inside the groove has a matching polygonal transverse section and is connected to the gasket by tearable narrow connecting bands placed at its corners.

4. Seal according to claim 3, characterized in that the groove and the tongue inside the groove have a transverse section in the shape of a trapezium the long base of which points toward the internal part of the gasket.

5. Seal according to claim 3, characterized in that the groove and the tongue inside the groove have a transverse section in the shape of a rectangle a long side of which points toward the internal part of the gasket.

6. Seal according to claim 2, characterized in that the groove has a polygonal transverse section and that the tongue inside the groove has a polygonal transverse section which differs from that of the groove and is connected to the gasket by tearable narrow connecting bands placed at its corners.

7. Seal according to claim 6, characterized in that the groove has a transverse section in the shape of a rectangle a long side of which points toward the internal part of the gasket and the tongue has a transverse section in the shape of a T defined by a foot and a crossbar pointing respectively toward and away from the internal part of the gasket.

8. Seal according to claim 1, characterized in that the tongue has a configuration chosen from the configurations in which, respectively, it lies flush with the regions of the external part of the gasket directly adjacent to the groove, or stands proud of or is set back from these regions.

9. Seal according to claim 1, wherein the seal has at least one longitudinal channel in at least one of the tongue and respectively on either side of the groove, in the external part of the gasket.

10. Seal according to claim 1, wherein the seal has at least one longitudinal channel in the internal part of the gasket.

11. Method for producing a seal according to claim 1, between a lateral face of a first component and an application face of a second component, comprising:

producing a longitudinal gasket made of an elastically compressible material having an internal part for attaching to the lateral face of the first component and an external part for bearing on the application face, wherein one of a process of molding and extrusion is used for producing the longitudinal gasket; and producing, at the same time the longitudinal gasket is being produced, in the external part, at least one longitudinal profiled groove delimited by an internal face and open on the opposite side to the internal part and a longitudinal profiled tongue housed inside the groove and attached to the internal face of the groove in an easily detachable way.

12. Method according to claim 11, wherein the producing of the groove and the tongue as a single piece with the gasket, while the longitudinal gasket is being produced, further comprises forming, in the external part, at least one longitudinal empty space bounding the tongue and defining at least one easily tearable narrow band for connecting the tongue and the gasket together.

13. Method of claim 11, further comprising forming at least one longitudinal channel in at least one of the tongue and respectively on either side thereof, in the external part to of the gasket while the gasket is being produced.

14. Method of claim 11, further comprising forming at least one longitudinal channel in the internal part of the gasket while the gasket is being produced.

15. Method of claim 11, further comprising removing the tongue from the groove over at least part of the length of the seal in order to improve at least one of its capacity for deformation and alter its transverse dimensions, to suit specific requirements, over the corresponding length.

16. Method of claim 15, further comprising attaching the gasket via its internal part to the lateral face of the first component between the time of its production, with the groove and the tongue, and the detachment of the tongue.

17. Method of claim 11, further comprising removing the tongue from the groove over at least part of the length of the seal; and partially replacing the removed tongue with an auxiliary profiled seal that is inserted and held in the groove in order to vary at least one of the degree of compressibility and the transverse dimensions of the seal, to suit specific requirements.

18. Method of claim 17, further comprising choosing a transverse section for the auxiliary seal from a range including a transverse section more or less equal to that of the groove and transverse sections which respectively have a height (h) greater than the depth (p) of the groove so as to stand proud from the gasket, or a height (h) smaller than the depth (p) of the groove so as to be set back inside the gasket.

19. Method of claim 17, further comprising choosing a rigidity for the auxiliary seal from rigidities that are respectively identical to, or greater or less than that of the gasket.

20. Method of claim 17, wherein the auxiliary seal is a seal that swells in the presence of water.

21. Concrete component, having a lateral face to which a seal is attached facing an application face belonging to another, adjacent, component, wherein the seal is in accordance with claim 1.

22. Concrete component according to claim 21, wherein the concrete component has two copies of said lateral face defining a corner between them, in that each of these copies is fitted with a seal in accordance with claim 1, except for a respective region directly adjacent to the corner, and in that the corner and the directly adjacent regions are fitted with a shaped seal connected in leaktight fashion to the seals of the lateral faces.

23. Concrete component according to claim 22, wherein the shaped seal comprises a shaped gasket connected in leaktight fashion to the gaskets of the seals of the lateral faces and comprising an internal part for attaching to said regions adjacent to the corner and an external part for bearing on a respective application face and in that the external part delimits a sealed cavity housing a mass of material that swells in the presence of water, said cavity being closed on the opposite side to the internal part by an impervious elastic membrane and opening toward the groove of the gaskets of the seals of the lateral faces so that by detaching at least one of the tongues from these gaskets, especially in a localized way in immediate proximity to the shaped seal, the leaktight barrier around the mass of material that swells in the presence of water can be broken.

24. Concrete component according to claim 22, wherein the shaped seal comprises a shaped gasket connected in leaktight fashion to the gaskets of the seals of the lateral faces and comprising an internal part for attaching to said regions adjacent to the corner and an external part for bearing on a respective application face and in that the external part delimits a sealed cavity housing a mass of material that swells in the presence of water, said cavity being closed on the opposite side to the internal part by an impervious membrane that can be torn, perforated or cut so that by tearing, perforating or cutting said membrane the leaktight barrier around the mass of material that swells in the presence of water can be broken.

25. Assembly of a concrete component according to claim 21 and of at least one other, adjacent, concrete component that has a face opposite said lateral face, wherein the seal is applied directly to said opposite face that constitutes the application face.

26. The concrete component of claim 25, wherein the at least one adjacent concrete component is an arch segment.

27. Assembly of a concrete component according to claim 21 and of at least one other, adjacent, concrete component that has a face opposite said lateral face, characterized in that a seal especially one according to claim 1 is attached to said opposite face too, and in that the seals are pressed together.

28. The concrete component of claim 21, wherein the concrete component is an arch segment.

* * * * *